United States Patent [19]

Notelteirs

[11] 4,081,708

[45] Mar. 28, 1978

[54] INCANDESCENT LAMP-REFLECTOR UNIT

[75] Inventor: Victor Rosallie Notelteirs, Eindhoven, Netherlands

[73] Assignee: U.S. Philips Corporation, New York, N.Y.

[21] Appl. No.: 693,946

[22] Filed: Jun. 8, 1976

[30] Foreign Application Priority Data

Jun. 18, 1975 Netherlands ..... 7507227

[51] Int. Cl.[2] ..... H01J 5/16; H01J 61/40; H01K 1/26; H01K 1/30

[52] U.S. Cl. ..... 313/113; 313/315

[58] Field of Search ..... 313/113, 331, 332, 315

[56] References Cited

U.S. PATENT DOCUMENTS

| | | | |
|---|---|---|---|
| 1,998,967 | 4/1935 | Raynolds | 313/113 |
| 2,795,722 | 6/1957 | Burgener et al. | 313/113 X |
| 2,843,778 | 7/1958 | Falge | 313/113 |
| 3,325,665 | 6/1967 | Meijer et al. | 313/113 |
| 3,488,543 | 1/1970 | Ridder et al. | 313/113 |
| 3,987,326 | 10/1976 | Lindae | 313/113 |

*Primary Examiner*—Saxfield Chatmon, Jr.
*Attorney, Agent, or Firm*—Frank R. Trifari; Robert S. Smith

[57] ABSTRACT

An incandescent lamp-reflector unit having a metal reflector in which, for increasing the reflecting surface, the neck aperture of the reflector is maintained as small as possible, is not flash-over-safe due to the small distance between bare parts of the neck of the reflector and the contact pins of the lamp. The unsafety is removed by causing the said distance to be larger than the smallest distance of the pins and the neck of the reflector by means of an insulating envelope of the pins and/or an insulating coating on and near the end face of the neck of the reflector.

4 Claims, 2 Drawing Figures

INCANDESCENT LAMP-REFLECTOR UNIT

Figure 1:
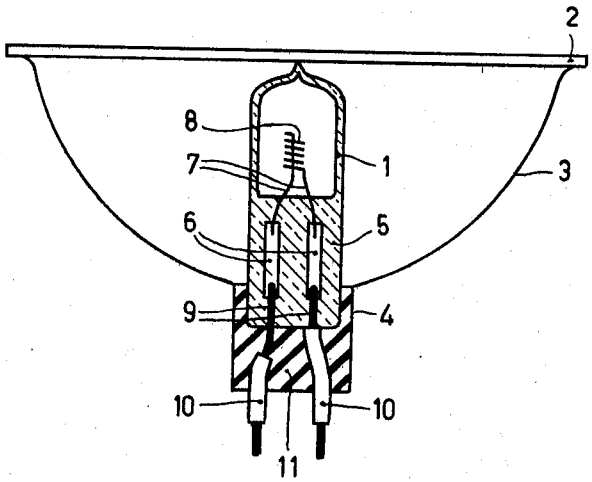

The invention relates to an incandescent lamp-reflector unit comprising (a) a concave reflector having a portion reflecting radiation emitted by the incandescent lamp and a neck-shaped portion, and (b) a mono-pinch halogen incandescent lamp having a quartz glass lamp envelope and foils in the pinch seal to which foils are connected at one end internal current conductors to the filament and at the other end external current conductors serving as contact pins, the pinch of the lamp envelope being incorporated in the neck-shaped portion of the reflector and being cemented therein in such a manner that the contact pins extend to beyond the neck-shaped portion.

Such a unit is known from the Netherlands patent application No. 6,701,519 laid open to public inspection. The reflector in the known unit consists of a glass member the reflecting portion of which is provided with a reflecting layer on its inside.

A drawback of the known unit is that the light radiated by the incandescent lamp in the direction of the neck of the reflector is not reflected or at least is not reflected as a beam. In order to increase the reflecting power of the reflector as much as possible, the neck of the reflector should be chosen to be as narrow as possible. This means that the diameter of the reflector neck is chosen to be so small that the neck can just incorporate the pinch of the lamp envelope and that sufficient play is present to orient the incandescent lamp in the reflector during cementing.

In the known glass reflector unit it does not matter when as a result of this the contact pins emanate from the neck of the reflector at a small distance from the wall. If, however, for economical reasons a metal reflector is used, the unit no longer satisfies the requirements which are imposed with respect to flash-over safety.

This drawback makes itself felt even more considerably if lamps would be used which are miniaturised to such an extent that the distance intermediate the contact pins emanating from the pinch of the lamp envelope is smaller than the standardised distance of the connector sockets to which the lamp is to be connected. In such lamps the distance of the contact pins outside the pinch of the lamp envelope should be increased to the desired value as a result of which the distance from the contact pins to the wall of the neck of the reflector becomes even smaller.

This problem presents itself not only in lamps which are designed for a terminal voltage of 110 or 220 volts, but also, for example, in 8 or 24 volts lamps which are fed by a transformer with leakage currents.

It is an object of the invention to provide a solution to the problem of providing a flashover-safe incandescent lamp-reflector unit having a metal reflector, while nevertheless in a given incandescent lamp, in partiticular in a miniaturised incandescent lamp, a reflector is used having a tight-fitting neck and therewith a maximum reflecting surface area.

According to the invention, an incandescent lamp-reflector unit is characterized in that the reflector is of metal and that means are present to cause the distance from bare parts of the contact pins to bare parts of the neck of the reflector to be larger than the smallest distance between the contact pins and the neck of the reflector.

In general it is to be assumed that a distance of 3 mm between bare parts of electric conductors at voltages up to 230 volts is sufficient to prevent flashover. This and larger distances can be realised according to the invention in several manners.

An insulating wrap may be provided around the contact pins at the area where they emerge from the cement present in the neck of the reflector. In a preferred embodiment, the pins are enveloped up to the pinch of the lamp envelope.

The envelope may consist of glass or ceramic, for example, in the form of a tube which is slid over the pins and which may or may not be tight-fitting. Envelopes may also be in the form of a coating, for example, a glass tube which is laid on and around the pins as a glass bead. Enameled pins are also to be understood as being coated.

In a preferred embodiment, the pins are surrounded by a wrap of a synthetic material, in a further preferred embodiment by a shrink wrap. For that purpose may be used inter alia wraps of polyvinyl chloride, polythene, fluoridised hydrocarbons and rubbers, such as silicon rubbers and neoprene.

A wrap of synthetic material has the advantage that, since the material is flexible, pins can be enveloped with it which have to be bent prior to or after enveloping so as to make their mutual distance equal to the standardised distance of the connector sockets to which the unit is to be connected. Bent pins can also be easily enveloped up to the pinch of the lamp envelope with a wrap of synthetic material.

As a rule, the envelope will not extend much farther than 3 mm beyond the edge of the neck of the reflector, since then no effective increase of the flash-over voltage is obtained.

An incandescent lamp-reflector unit according to the invention may also be realised by providing the neck of the reflector with an insulating coating on and near the end face. Particularly suitable for that purpose are synthetic materials, in particular epoxy resins.

The outside of the neck of the reflector will generally not be coated over a length larger than 3 mm since this will not result in any effective increase of the flash-over voltage. On the inside of the neck of the reflector the coating preferably adjoins the cement.

Incandescent lamp-reflector units according to the invention may be provided both with an envelope around the pins and with a coating on the reflector neck, although as a rule this does not present any further advantages.

It will be obvious that the metal of which the reflector is manufactured is of no significance for realising the invention. In general, however, aluminium or aluminium-coated iron will be used.

The incandescent lamp-reflector units according to the invention may be used for projection purposes, for example, in film projectors, as spot lights and the like. In that case the reflector may have the shape of an ellipsoid, a paraboloid or different and the reflective surface may be smooth or facetted.

The invention will be described in greater detail with reference to the figures.

Figure 2:
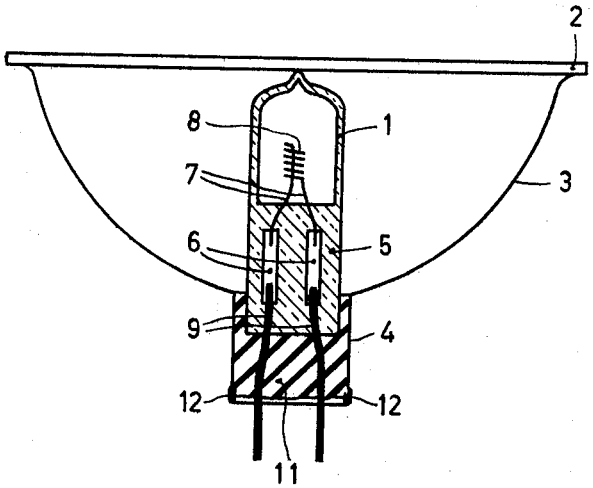

FIGS. 1 and 2 are sectional views through the axis of an incandescent lamp-reflector unit.

FIG. 1 shows a halogen incandescent lamp having a quartz glass lamp envelope 1 in an aluminium reflector 2 having a maxium diameter of 5 cm. Adjoining the reflecting portion 3 of the reflector is a neck-shaped portion 4 in which the pinch 5 of the incandescent lamp is incorporated. The pinch comprises molybdenum foils 6 to which are welded at one end internal current conductors 7 towards the filament 8 and at the other end external current conductors 9 serving as contact pins.

The pins 9 are enveloped by a P.V.C. shrink wrap 10. The lamp is secured in the neck of the reflector by means of cement 11.

The incandescent lamp is an 8 V 50 W halogen lamp filled with 3 atm Argon containing 0.3 mol.% of methylene bromide. The flash-over voltage in this unit proved to be more than 2000 V.

In FIG. 2, the reference numerals 1 to 9 and 11 denote the same parts as in FIG. 1 and 12 denotes a coating of epoxy resin. In this unit also the flash-over voltage was more than 2000 volts.

What is claimed is:

1. An incandescent lamp-reflector assembly comprising an incandescent lamp and a metallic reflector having a generally concave surface for reflecting radiation emitted by the incandescent lamp, and a neck-shaped element cooperating with said concave surfaces, said incandescent lamp being a halogen lamp having a single pinch, a quartz glass lamp envelope, two internal conductors and two foils in said pinch seal, one end of each of said foils being connected respectively to one of said internal current conductors, a filament disposed within said envelope and connected to the other ends of said internal current conductors, said lamp further including two external current conductors serving as contact pins at one extremity and at the other extremity being connected respectively to said foils, said pinch of the lamp envelope being disposed at least partly in said neck-shaped element with cement therebetween and with said contact pins extending beyond said neck-shaped portion and away from said concave surface, the distance from any bare part of any contact pin to any bare part of said metallic reflector being larger than the smallest distance between any part of any contact pin and said reflector.

2. An incandescent lamp-reflector assembly as claimed in claim 1 further including an insulating envelope enveloping each contact pin at the area where said external contact pins are bare and is proximate to said pinch.

3. An incandescent lamp-reflector unit as claimed in claim 2 wherein said envelope comprises a wrap of synthetic material.

4. An incandescent lamp-reflector unit as claimed in claim 1 wherein said neck of said reflector further includes an insulating coating on a part of said envelope.

* * * * *